United States Patent [19]

Normart

[11] 4,124,212

[45] Nov. 7, 1978

[54] GAME APPARATUS FOR BACKGAMMON FOR FOUR PLAYERS

[76] Inventor: Martin Normart, 36 Garfield Ave., Norwood, Pa. 19074

[21] Appl. No.: 771,249

[22] Filed: Feb. 23, 1977

[51] Int. Cl.[2] ..... A63F 3/02

[52] U.S. Cl. ..... 273/248

[58] Field of Search ..... 273/134, 136, 248; D34/5 SS

[56] References Cited

U.S. PATENT DOCUMENTS

| | | | |
|---|---|---|---|
| D. 84,477 | 6/1931 | Hirtenstein | 273/131 AB |
| D. 97,078 | 10/1935 | Lord | 273/134 AD |
| D. 117,405 | 10/1939 | Neas | 273/134 D |
| 222,272 | 12/1879 | Harmon | 273/136 C |

FOREIGN PATENT DOCUMENTS

| | | | |
|---|---|---|---|
| 10,857 of | 1889 | United Kingdom | 273/131 KC |

*Primary Examiner*—Harland S. Skogquist
*Assistant Examiner*—Harry G. Strappello
*Attorney, Agent, or Firm*—Woodcock, Washburn, Kurtz & Mackiewicz

[57] ABSTRACT

A game board apparatus for four players in which each player moves pieces through four groups of positions in conflict with the movements of the other players.

1 Claim, 1 Drawing Figure

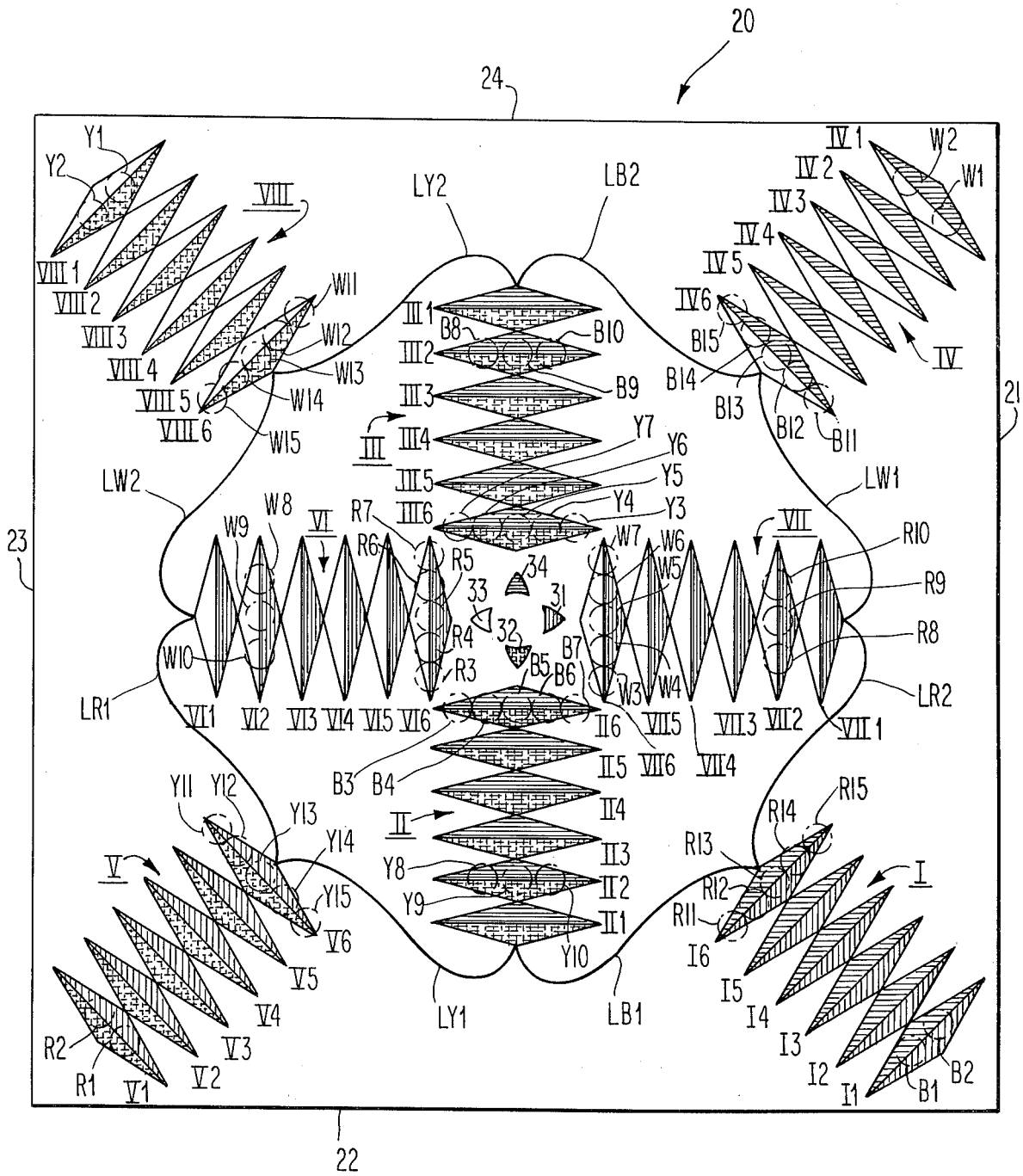
20
24
21
23
22
LY2
LB2
LW2
LW1
LR1
LR2
LY1
LB1
VIII
IV
III
VI
VII
II
V
I
Y1
Y2
W1
W2
W8
W9
W10
W11
W12
W13
W14
W15
R1
R2
R3
R4
R5
R6
R7
R8
R9
R10
R11
R12
R13
R14
R15
B1
B2
B3
B4
B5
B6
B7
B8
B9
B10
B11
B12
B13
B14
B15
Y3
Y4
Y5
Y6
Y7
Y8
Y9
Y10
Y11
Y12
Y13
Y14
Y15
31
32
33
34

GAME APPARATUS FOR BACKGAMMON FOR FOUR PLAYERS

BACKGROUND OF THE INVENTION

Numerous U.S. Patents have been issued for game board devices having a patterned board and movable pieces. See, eg., U.S. Pat. No. 3,863,927 granted Feb. 4, 1975 and patents referred to therein.

One of the oldest games of the type is Backgammon, a game played with two persons. In that traditional game, each player is assigned fifteen pieces of different color (usually red and white). The game board, usually squarish, has twelve positions at opposite sides, or a total of twenty-four positions.

In the traditional Backgammon game, the board is considered to be divided into four quadrants or "tables", comprising two tables per side, each containing six positions. These positions are typically triangular in shape and are called "points." White sits on one side and his "home" table is at his right and his "outside" table to his left. Red, sitting opposite, also has "home" and "outside" tables similarly positioned.

At the outset, each player has eight pieces on his home side (arranged with five pieces at point 6 and three pieces at point 8), and seven pieces on the opposite side (arranged with two pieces at the opponent's point 1 and five pieces at the opponent's point 12).

Pieces are moved, alternately by each player, according to the roll of dice, in opposite directions around the board. The pieces at the far side of the board from each player are moved laterally around the side of the board and laterally in front of the player through his outside table to his home table. Upon reaching the home table the pieces are removed from the board, a process referred to as "bearing off". More specifically, pieces may be borne off if their position on the home table coincides with the number on one of the dice thrown, eg., if one die is a 5, he may bear off one of his pieces at point 5 on his home table.

In the traditional game, there are numerous other rules and facets of play which are well known to those familiar with the game.

SUMMARY OF THE DISCLOSURE

The present invention comprises a new variation of the traditional Backgammon game whereby as many as four persons may play.

The numerous advantages and improvements will be discerned from the following description and from the drawing.

BRIEF DESCRIPTION OF THE DRAWING

The drawing is a top view of a preferred embodiment of the game board of the present invention with the game pieces arranged thereon.

DETAILED DESCRIPTION OF THE DISCLOSURE

The game consists of a game board, 60 playing pieces, and at least one set of dice. In the drawing, there is shown a preferred embodiment of the game board, generally identified as 20, with the playing pieces stationed at their preferred starting positions. (The board is squarish in its preferred embodiment and contains one hundred and eight plane figures.) Each of the playing pieces and each of the plane figures are colored one of four different colors. Which four specific colors are chosen is an arbitrary selection and has no bearing on the claimed invention. In the drawing the colors used are red, white, blue, and yellow.

There are forty-eight points or positions symetrically arranged on the surface of the board. Each point represents a space upon which two of the four players may land their pieces. Each point is preferably a quadrilateral and preferably (as shown) a rhombus type of parallelogram. Each point is divided into two halves. The two halves of each point are different colors. The forty-eight points are clustered into eight groups of six points each. Within each of the eight groups all six points have the same two colors.

In this application, for ease of reference, the points within a given group are prefixed by the Roman Numeral assigned to the group. Thus the group I contains points I1, I2, I3, I4, I5, and I6. The group II contains points II1–II6; group III contains points III1–III6; group IV contains points IV1–IV6; group V contains points V1–V6; group VI contains points VI1–VI6; group VII contains points VII1–VII6; group VIII contains points VIII1–VIII6.

As indicated, the game is meant to be played with four players, each of whom sits along a side. Thus, the player with the blue pieces sits along side 21, the red player along side 22, the yellow player along side 23, and the white player along side 24. Each player moves pieces of his or her respective color.

Each one of the four players moves his pieces through four of the eight groups of points. Two players may land pieces on the point(s) within any one group, provided the point bears the same color on one half as the player's color. Thus, within group I, points I1–I6, one half of each point is red and the other half blue to indicate that any one of these points may be occupied by either blue or red pieces. Within group II (points II1–II6), one half of each point is yellow and the other half is blue to indicate that any one of these points may be occupied by either yellow or blue pieces.

Each colored triangular half of each point operates as an "arrowhead" or direction indicator to indicate the direction of the movement of the pieces of the same color. Thus, as the two halves of each point in any group are pointed in opposite directions, the two players whose pieces may occupy the points within any one group move their pieces in opposing directions.

Seen in turn from each of the four players' respective sides of the board, the four groups of points through which each player advances his pieces are identically positioned at the beginning of the game. Thus, for example, seen from blue's side 21, blue's first group (I) of points is positioned diagonally in the lower left corner of the board, blue's second group (II) of points is positioned laterally to the left of the center of the board, blue's third group (III) of points is positioned laterally to the right of the center of the board, blue's fourth group (IV) of points is positioned diagonally in the lower right corner of the board.

Directional guidance in moving pieces from group to group is provided by eight curved guidelines or paths which connect each one of the four corner groups with the two nearest adjacent center groups. Thus, the blue guideline LB1 connects group I point 6 with group II point 1 and indicates the path the blue pieces take in moving from group to group across the board. Similarly, the blue guideline LB2 connects group III point 1 with group IV point 6, the red guideline LR2 connects group VII point 1 with group I point 6, etc.

For additional guidance in moving pieces from group to group there may be arrow-shaped symbols or direction markers 31–34 at the center of the board. Thus, symbol 31 is red and indicates the direction of red's movement, symbol 32 is yellow and indicates the direction of yellow's movement, symbol 33 is white and indicates the direction of white's movement, and symbol 34 is blue and indicates the direction of blue's movement.

The points within each group are sequential for each player. Thus, for example, within group I, point I1 is blue's first point and red's sixth point; point I2 is blue's second point and red's fifth point; point I3 is blue's third point and red's fourth point; point I4 is blue's fourth point and red's third point, etc.

The eight groups of points on the board are also sequential. Thus, blue's first group of points, group I, is red's fourth group of points. Blue's second group of points, group II, is yellow's third group of points. Blue's third group of points, group III, is yellow's second group. Blue's fourth group of points, group IV, is white's first group. Yellow's first group of points, group VIII, is white's fourth group. Yellow's fourth group of points, group V, is red's first group. Red's second group of points, group VI, is white's third group. Red's third group of points, group VII, is white's second group.

As in traditional Backgammon, the winner of the game is the first player to advance all of his pieces through his four groups of points and off the board. No player may remove any of his pieces from the board until he has first advanced all of his pieces into his fourth and last group of points, his "home" group. The pieces are advanced in strict accordance with the rolls of the dice and are not permitted to move backward. The pieces are permitted to land on any point of their color which is not already occupied by two or more of one of their opponents' pieces.

Any single piece occupying a point by itself is called a "blot". An opposing player (providing he rolls the exact number) can land on a blot. This is what is called "hitting a blot" in Backgammon. Any solitary piece which is to "hit", regardless of how far it has advanced across the board, is in effect "captured" and sent back to the beginning. Captured pieces are thus removed from the board and are permitted to re-enter the game only when the player thereof has rolled a number that corresponds to the number of a point within his or her first group of points (in blue's case this is group I, in red's case this is Group V, etc.) which is not occupied by two or more of their opponents' pieces. Furthermore, any player whose piece has been hit and captured may not advance any of his pieces on the board until he has re-entered his captured piece.

The board shown in the drawing depicts the pieces at the outset of the game. Each player's pieces are spaced and aligned in a pattern identical to that used in the classic Western version of Backgammon. However, it should be noted that it is possible to initiate a game with pieces stationed in other positions, or even off the board as in a Russian version of Backgammon.

As shown in the drawing, blue, to take an example, has a total of 15 pieces. Two pieces, B1 and B2, are stationed at group I point 1; five blue pieces identified as B3, B4, B5, B6, and B7, are stationed at group II point 6; three blue pieces, identified as B8, B9 and B10, are stationed at group III point 2; five blue pieces, identified as B11, B12, B13, B14, and B15, are stationed at group IV point 6. From the drawing it will be observed that the three other players each have 15 pieces with the same respective positioning around the board.

At the outset of play, the dice are rolled and the player with the highest combined score initiates the first move. Depending upon the preference of the players, those moving after the person with the highest roll of the dice may be either according to their respective scores on their own roll of the dice or play can move to the left of the person who achieves the first move.

For the sake of illustrating the dynamics of the game, an example follows of initial moves by each player which intentionally leave blots.

Assume that blue obtains the highest score with a roll of 6–3 and moves first. Blue may choose to take this roll in one of two different ways. He may advance one piece 6 points and then advance the same piece again 3 more points for a total move of 9, or he may choose to advance one piece 6 points and then advance a second piece 3 points.

Assume that blue chooses to advance piece B1 six points. B1 would thus advance from group I point 1 to group II point 1. For his 3 roll, blue chooses to advance piece B8. B8 would thus advance from group III point 2 to group IV point 5.

If the roll is passing to the left, red would be the next player to move. Assume that red's first roll is 5–1. Red chooses to advance piece R-11 5 points from group 1 point 6 to group 1 point 1. With this move red hits blue's blot on group I point 1, and captures blue's piece B2. To take his 1 roll, red advances piece R-1 from group V point 1 to group V point 2.

Yellow would be the next player to roll. Assume that yellow's first roll is 6—6. Since yellow has rolled a double, he must move that number four times. For his first 6, yellow chooses to advance piece Y3 from group III point 6 to group II point 1, hitting blue's second blot on group II point 1, and capturing B1. For his second 6 yellow continues to advance piece Y3, moving it from group II point 1 to group V point 1, thus hitting red's blot on group V point 1, and capturing R-2. For his third 6 yellow advances piece Y-8 from group II point 2 to group V point 2 hitting red's blot on group V point 2 and capturing R-1. For his fourth 6 yellow advances piece Y1 from group VIII point 1 to group III point 1.

White's first roll is 4–5. For his 4 white advances piece W-1 from group IV point 1 to group IV point 5, hitting blue's blot on group IV point 5, and capturing B-8. For his 5 roll white advances piece W11 from group VIII point 6 to group VIII point 1 hitting yellow's blot on group VIII point 1, and capturing Y2.

Thus, as the example illustrates, each player is simultaneously in conflict with each of his three opponents on different sections of the board throughout much of the game, thereby making an exciting and dynamic game.

From the foregoing, it will be understood that a number of modifications may be made in the method of playing the game of this invention. For example, the game potentially may be played with more or less than the 15 pieces which are preferred by the present inventor. It would be unlikely that an interesting game would be produced by utilizing more than 15 pieces, although that is possible, but it would be possible to play the game with fewer than 15 pieces and, in such event, a faster game probably would occur, on the average. Although the game is intended for play by four individuals, it is possible that it can be played with two or three persons, although that is not preferred by the present inventor.

Similarly, the particular symetrical arrangement of the board shown in the drawing and described herein, while preferred by the present inventor, could be changed by somewhat different positioning of the groups, or the groups could even be oriented in different positions. However, these changes are not thought to be desirable or preferable. Alternatively, the game could be modified by utilizing less than six points in some or all of the groups.

While the invention has been illustrated and described in its preferred embodiment, it should be understood that the invention is not to be limited to the precise details illustrated herein and described above since the same may be carried out in other ways falling within the scope of the invention as illustrated and described.

I claim:

1. A game apparatus comprising:

a. a game board having a squarish shape and having at least eight spaced apart groups of positions, each group containing six positions;

b. said game board having at least four sides, each side comprising a playing location for a player, one group of said positions being arranged in each of the four corners of the board and four groups of said positions being arranged in the approximate center of the board;

c. a set of pieces for each player, each set having a respective color;

d. paths on the board indicating movement of the pieces of each player through successive playing positions in a direction which is opposed to the direction of movement of the pieces of the other three players, said paths including lines indicating paths of movement which connect each group of positions arranged at each respective corner of the board with the two nearest groups of positions arranged in the center of the board;

e. said positions being quadrilateral in shape, and wherein within each group the positions have colors limited to the colors of the pieces which may move within such group, so as to indicate path of movement for the pieces of each player; and f. wherein a first group of positions is to the left of each player's playing location, and a respective last group of positions is to the right of each such playing location, and wherein indicator paths comprising said lines and said position colors within each group are provided to indicate the path of movement for each player from each respective first group through other groups to each respective last group.

* * * * *